United States Patent [19]

Wilson

[11] 4,206,679

[45] Jun. 10, 1980

[54] ELECTRIC SPANISH GUITAR, AND NUT INCORPORATED THEREIN

[75] Inventor: Gregg Wilson, Irvine, Calif.

[73] Assignee: CBS Inc., New York, N.Y.

[21] Appl. No.: 6,795

[22] Filed: Jan. 25, 1979

Related U.S. Application Data

[63] Continuation-in-part of Ser. No. 895,460, Apr. 11, 1978, abandoned.

[51] Int. Cl.[2] ..... G10D 3/04

[52] U.S. Cl. ..... 84/314 N

[58] Field of Search ..... 84/314 R, 314 N

[56] References Cited

U.S. PATENT DOCUMENTS

| | | | |
|---|---|---|---|
| 582,030 | 5/1897 | Walker | 84/314 |
| 642,472 | 1/1900 | Menze | 84/314 |
| 1,365,839 | 1/1921 | McHugh et al. | 84/307 |
| 2,214,957 | 9/1940 | Furgiuele | 84/314 N |
| 2,309,082 | 1/1943 | Smith et al. | 84/314 N |

FOREIGN PATENT DOCUMENTS

| | | | |
|---|---|---|---|
| 394989 | 5/1924 | Fed. Rep. of Germany | 84/314 N |

*Primary Examiner*—Lawrence R. Franklin
*Attorney, Agent, or Firm*—Gausewitz, Carr & Rothenberg

[57] ABSTRACT

The electric Spanish guitar incorporates a unitary nut element which has a plurality of edges offset from each other, the offsets being such that each string bends sharply at two places before being secured to a turning screw. Such edges for each string are at the ends of a passage through which the string passes. The axis of each passage is inclined relative to the axis of the guitar neck, thus producing the indicated offset. The inclination of each passage is such that each bend is through an angle in excess of 10 degrees and preferably in excess of 15 degrees. The nut is mounted fixedly on the neck of the Spanish guitar, in the same location normally occupied by a conventional nut, and in place of such conventional nut.

17 Claims, 5 Drawing Figures

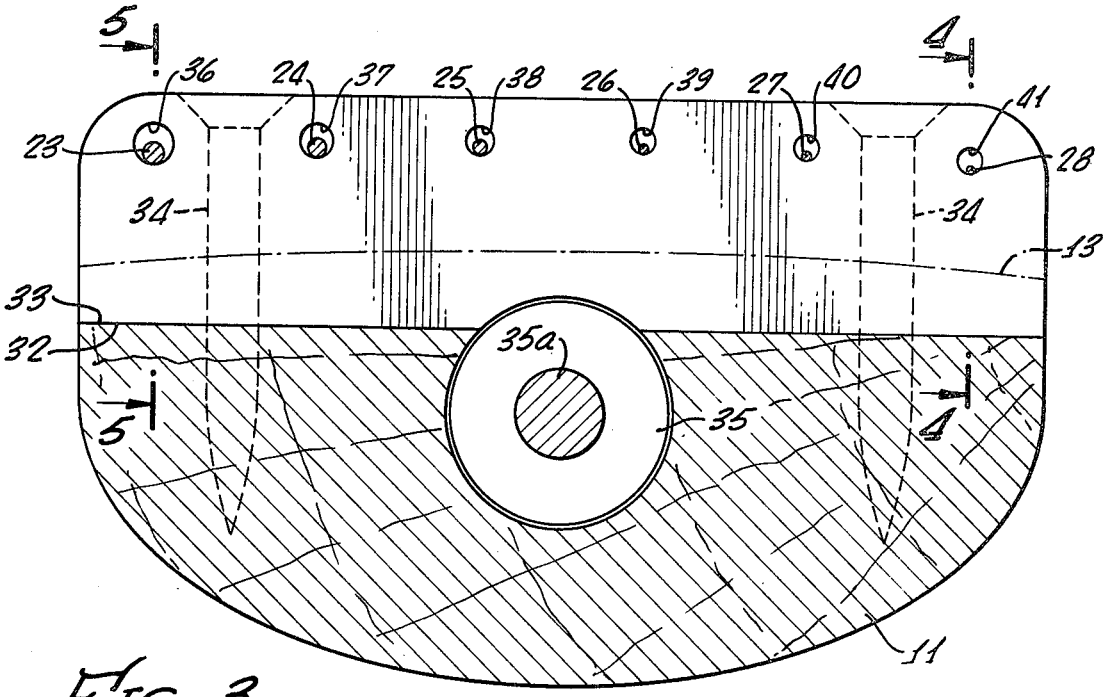
FIG. 3.
FIG. 4.
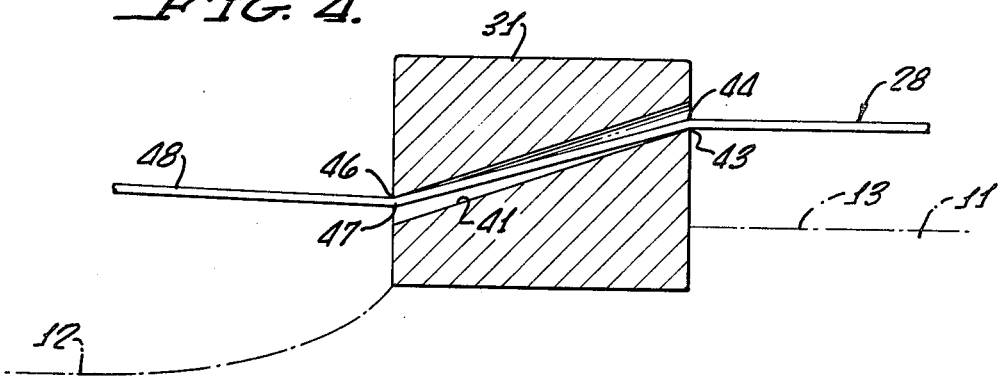
FIG. 5.
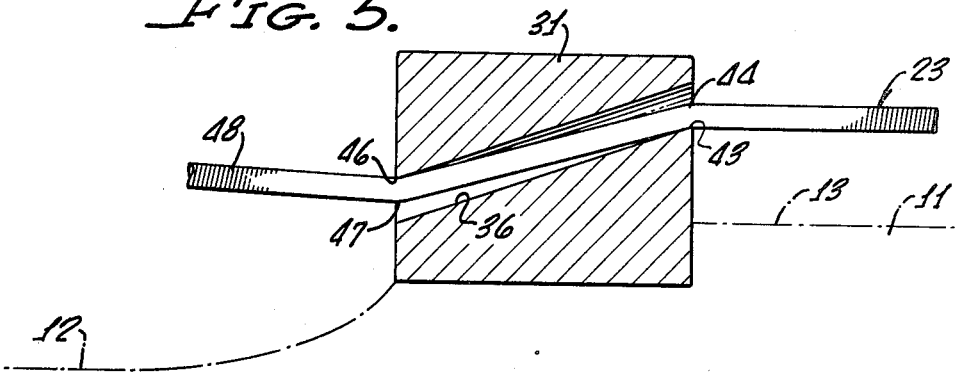

ELECTRIC SPANISH GUITAR, AND NUT INCORPORATED THEREIN

CROSS REFERENCE TO RELATED APPLICATION

This application is a continuation-in-part of my copending application Ser. No. 895,460, filed Apr. 11, 1978, now abandoned for Electric Spanish Guitar, and Nut Incorporated Therein.

BACKGROUND OF THE INVENTION

1. Field of the Invention

This invention relates to the field of electric guitars of the Spanish type, as distinguished from Hawaiian or steel guitars.

2. Description of Prior Art

It has long been conventional, in electric Spanish guitars, to stretch the strings over a bridge on the body of the guitar and over a nut located at the junction between the fingerboard and the head. Thus, the long operative or "working" portions of the strings are defined between the bridge and the nut. After passing over the nut, in notches or narrow grooves therein, the strings connect to tuning screws located on the head.

At least relative to two of the strings on one major type of electric Spanish guitar, there are "string guides" on the head, beneath which such strings pass after bending over the nut. The string guides are actually hold-down elements to make sure that the strings do not become even momentarily disengaged from the nut when the amplitudes of vibration are great.

The increasing of the dwell time of a vibrating guitar string is a major goal of guitar designers, since musicians want the sound produced by each plucking action to continue for a substantial time period. Stated conversely, it is desired that the decay rate (decrease in amplitude of vibration) be low. Prior-art attempts to increase dwell (or "sustain") and reduce decay have been unsuccessful to date, particularly because in Spanish guitars (as distinguished from conventional Hawaiian guitars), the thin, long wooden necks tend to vibrate (resonate) in response to string vibration and this represents lost mechanical energy which reduces dwell. For the same pitch, in the open-string condition, the string of a Spanish guitar is conventionally smaller in diameter—and under less tension—than is the string of a Hawaiian guitar.

It is possible to increase dwell substantially, even in Spanish guitars, by using heavy string-anchoring elements, unsightly elements, complex and expensive elements, etc. However, in no case known to applicant has the dwell been increased markedly by a simple, inexpensive, light, good-looking element which need have no movable parts. The present invention does achieve this long-desired result and, furthermore, achieves the advantage of making it possible to eliminate the above-indicated string guides with attendant cost saving.

SUMMARY OF THE INVENTION

The present electric Spanish guitar incorporates a unitary nut element having, for each string, two edges spaced from each other and offset to a substantial extent. Thus, the junction between the operative (working) string portion and a short string portion within the nut is a first bend. There is a second bend between such short string portion and the string portion which extends—under tension—to a tuning screw on the head.

The amount of offset is sufficient, and the other characteristics of the nut element are such, that the dwell of the string is increased by a large percentage.

Stated more specifically, the nut element is a block having a passage therethrough for each string. Each passage inclines at a substantial angle to the operative string portion and to the axis of the guitar neck. The amount of the angle, and the length of the passage, are such that there are two distinct and relatively sharp bends in each string—one bend at each end of the passage. The bends are in opposite directions, and each has a magnitude greater than 10 degrees and preferably greater than 15 degrees.

Because each string is confined in its passage through the nut, there is no possibility that even large-amplitude string vibrations will cause a string to separate from the nut and shift to an undesired position.

The nut is fixedly, firmly, and non-slidably mounted at the outer end of the neck of the Spanish guitar, in the location normally occupied by a conventional nut, and in place of such conventional nut.

BRIEF DESCRIPTION OF THE DRAWINGS

FIG. 3 is an enlarged cross-sectional view of the neck, the section being taken at the nut; and FIGS. 4 and 5 are longitudinal sectional views taken respectively on lines 4—4 and 5—5 of FIG. 3.

DETAILED DESCRIPTION OF THE PREFERRED EMBODIMENT

Figure 1:
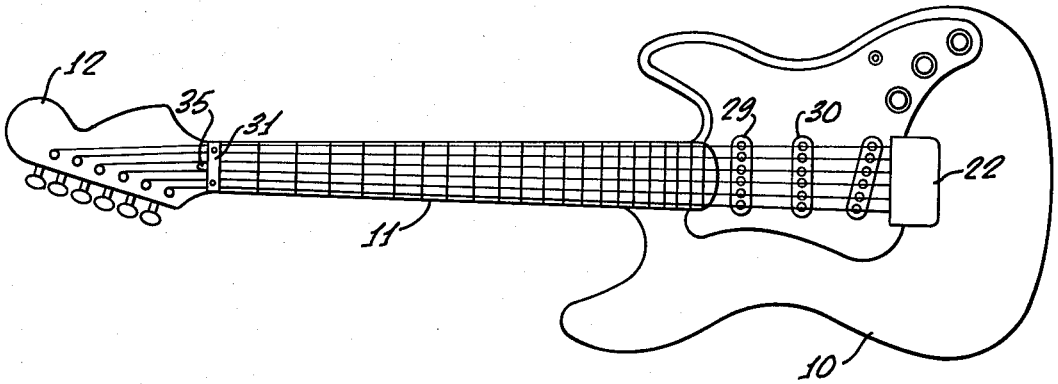
FIG. 1 shows an electric Spanish guitar incorporating the present invention.
Figure 2:
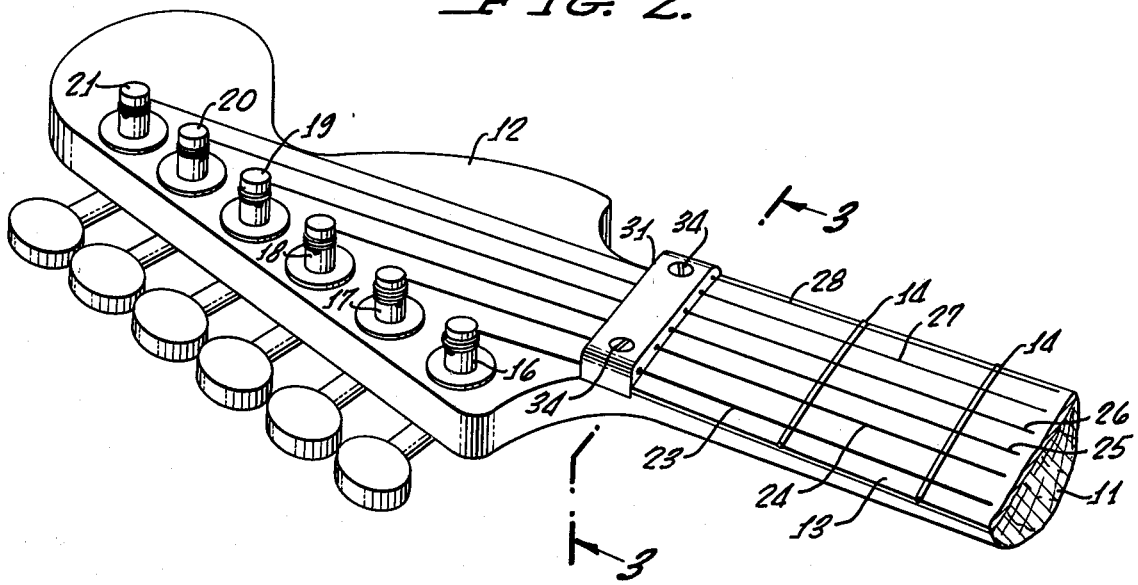
FIG. 2 is an isometric view of the head, nut and outer neck end of the guitar shown in FIG. 1.

Referring first to FIGS. 1 and 2, a solid-body electric guitar is shown as comprising a relatively flat solid wooden body 10 from which extends an elongated wooden neck 11 having a head 12 at the outer end thereof. Provided along the upper surface of neck 11 is the fingerboard 13, there being frets 14 located at spaced intervals along the fingerboard.

The upper surface of fingerboard 13 lies along the surface of an imaginary large-diameter cylinder the axis of which is far below the neck and parallel thereto. The upper surface of head 12 is somewhat below that of the fingerboard, and has tuning screws or pegs 16–21 projecting perpendicularly therefrom as is conventional in six-stringed electric Spanish guitars of the indicated type. Such screws or pegs are rotated (through gears, not shown) by knobs associated therewith in order to increase or decrease string tension.

A guitar bridge is indicated at 22 and may be of any suitable construction, preferably of the general type shown in FIG. 1 of U.S. Pat. No. 2,741,146, which patent is hereby incorporated by reference herein as though set forth in full. However, in the present bridge there is no vibrato action (such as is shown in the patent), the upper plate of the bridge (numbered 14 in the referenced patent) being instead secured to the guitar body. The bridge, as described in the referenced patent, is connected to a relatively heavy metal inertia block which projects into the guitar body. Such inertia block is bolted fixedly to the body.

Six strings 23–28 are anchored in the guitar body at a region on the opposite side of bridge 22 from the neck and head. This anchoring is effected by enlarged ends such as are described in U.S. Pat. No. 3,777,613, which is hereby incorporated by reference as though set forth in full. The strings 23–28 are metal strings having magnetizable cores which disturb the fields of electromagnetic transducers (pickups) such as are shown at 29 and 30 in FIG. 1. Thus, the string vibrations are sensed, and the resulting currents are amplified electrically and then transmitted to loudspeaker means, not shown.

The three lower-pitched strings, numbers 23–25, are tightly wrapped with a suitable metal such as nickel or nickel steel. The three higher-pitched strings, numbers 26–28, are not wrapped (are bare). As is conventional, the string diameters vary progressively from the lowest-pitched string 23 (the "sixth string") to the highest-pitched string 28 (the "first string").

DESCRIPTION OF THE NUT

Referring next to FIGS. 2 and 5, the nut is indicated at 31 and is a block of a hard, dense material such as metal—preferably brass and (less preferably) aluminum. The indicated metals are somewhat less hard than are the metals forming strings 23–28, thus minimizing the possibility of wear on or damage to the strings caused by the nut.

The lower surface of the block forming nut 31 is flat, as shown at 32 in FIG. 3, and is in close engagement with a seat (shelf or ledge) 33 formed on the guitar neck at the outer end of fingerboard 13. Two screws, numbered 34, project vertically downwardly through the nut at the ends thereof and are threaded into the neck to hold the nut tightly against seat 33. The nut is thus held tightly, firmly and non-slidably on seat 33 in close association therewith. This is to increase the dwell or sustain in comparison to what would be the case if the nut were freely or slidably associated with the guitar neck.

At its central region, the lower surface 32 of the nut is recessed somewhat in order to receive the upper portion of a different kind of nut—namely an elongated bullet-shaped (in the present embodiment) internally-threaded nut 35 (FIGS. 1 and 3) which is provided at the end of a truss rod 35*a* in the neck of the guitar. Such truss rods are conventional and prevent excessive bowing of the neck as well as permitting adjustment of the string elevation relative to the upper surface of the fingerboard.

Six small-diameter bores or passages, numbered 36–41, are provided through the metal block forming nut 31, namely between the vertical inner face of the block (relatively adjacent the body of the guitar) and the vertical outer face thereof (relatively adjacent the tuning screws). Each such bore is sufficiently large to receive the associated one of the strings 23–28, and also to receive other and somewhat larger-diameter strings which a particular musician may desire to employ.

The operative or working portions of strings 23–28 are parallel to each other and also parallel to the upper surface of the fingerboard, being (conventionally) each spaced the same distance above such upper fingerboard surface. (Thus, as above indicated, the operative portions lie on the surface of an imaginary large-diameter cylinder.) Each string is also substantially parallel to the axis of neck 11. Bores or passages 36–41, however, are not parallel to the strings (that is to say, to the operative or working portions of the strings) nor to the neck axis, being instead inclined relative thereto at a substantial angle.

Preferably, each bore 36–41 lies in a plane which is perpendicular to the "plane" of the upper fingerboard surface and to the "plane" of the strings. The planes containing the bores are parallel to each other, and to the axis of the neck. The bores are spaced laterally from each other by the distances conventionally present between guitar strings at the nut.

Referring to FIGS. 4 and 5, the inner ends of the bores or passages (the bore ends relatively adjacent the bridge) are disposed at an elevation corresponding generally to that of the notches in a conventional nut. The inner bore ends, as shown in FIG. 3, do not lie along a straight line but instead along a gradual curve corresponding to that of the above-mentioned imaginary cylinder. The outer bore ends, relatively adjacent the tuning screws, are disposed much lower than are the inner ends. Thus, the bores—which are straight—incline downwardly and outwardly from relatively "high" inner ends to relatively low outer ends, the latter being relatively close to the plane of the upper surface of head 12.

With the described construction, there is—for each string—a first edge at the inner face of the nut block, such edge being numbered 43. The string bends sharply at this edge, as shown at 44. At the outer face of the guitar block, there is a second edge 46 at which a second string bend 47 occurs. In the preferred construction, the first bend is downwardly and the second bend is upwardly, the bends thus being in opposite directions.

Each bend is sufficiently sharp to minimize transmission of vibrations therethrough. Accordingly, the string portions 48 between second edge 46 and the respective tuning screws 16–21 are relatively free of vibrations. These string portions 48 may, for convenience, be referred to as "inoperative" string portions since it is not desired that they vibrate.

The magnitude of each bend in each string is in excess of 10 degrees, and is preferably in excess of 15 degrees. However, neither bend should be so sharp as to interfere with the tuning functions of elements 16–21, or to create a danger of damage to or weakening of the strings.

The tuning screws 16–21 may have annular recesses therein at predetermined elevations above the upper surface of the head, and these recesses may be somewhat above the second edges 46 of the bores 36–41. Thus, the inoperative string portions 48, which extend to the tuning screws from the second edges, may incline somewhat upwardly relative to the surface of the head. Alternatively, the inoperative string portions 48 are substantially parallel to the head.

In the preferred construction, the inclination of each bore relative to the "planes" of the strings and fingerboard is about 20 degrees (for example, 18 degrees). A preferred spacing between the outer (left in FIGS. 4 and 5) and inner (right in FIGS. 4 and 5) vertical faces of the nut block is ½ inch. With this inclination, and this spacing, the bends 44 and 47 are sufficiently sharp that the sustain or dwell is increased markedly and, furthermore, the strings are effectively held in continuous engagement with the first edges 43. No string guides are shown in the present drawings since none is necessary, although string guides may be employed if desired on particular types of guitars.

A spacing, between the outer and inner vertical nut faces, of greater than ½ inch does not increase sustain, whereas a spacing less than ½ inch reduces it—thus making about ½ inch the preferred spacing.

It will thus be seen that the first and second edges 43 and 46 are offset from each other sufficiently to provide the stated bends. Furthermore, the axis of each passage (that is to say, of each bore 36–41) is inclined relative to the axis of the neck. The first bend 44 is seen to be at the junction between the long, operative string portion and a short string region contained within the bore, whereas the second bend 47 is between the stated short string portion and the inoperative string portion 48. It is emphasized that the "inoperative" string portion 48 of each string is under tension, the string being stretched between a tuning screw 16–21 and the anchor point to the guitar body.

SPECIFIC EXAMPLE

In a specific example, which is given by way of illustration and not limitation, the nut block 31 is formed of brass, weighs somewhat over 2 ounces, and has a spacing of ½ inch between the vertical inner and outer faces. Bore 36 has a diameter of 0.067 inch and contains a string 23 having a diameter of 0.038 inch. The diameter of bore 37 is 0.055 inch and that of the string 24 contained therein is 0.032 inch. The diameter of bore 38 is 0.046 inch, whereas that of the contained string is 0.026 inch. Each of bores 39–41 has a diameter of 0.040 inch, whereas the strings 26–28 respectively contained therein are 0.015 inch, 0.013 inch and 0.010 inch.

In comparative tests, using an oscilloscope with a slow sweep, decay time was measured between an instant when the output of the transducer (as limited by the volume control element of the guitar) was 60 millivolts to the instant when the output of the transducer (as thus limited) was 10 millivolts. This 60–10 relationship was employed relative to the first five strings (namely, the five higher-pitched strings 24 through 28. Relative to the sixth string 23, the lowest pitched one, measurements were made between a time when the output voltage from the transducer (as thus limited by the volume control) was 80 millivolts to a time when it was 20 millivolts, this latter being done because the dwell was so long that it exceeded the capability of the oscilloscope at the slowest sweep. The 60 and 80 millivolt readings occurred at the instant of "attack," namely at the instant the string is released by the pick or by the finger of the guitarist.

The results of the tests varied widely, but show that, typically, the increase in dwell and sustain time between the above-stated instants is in the range of about 30 percent to about 50 percent. The increase is sometimes smaller than that stated, and sometimes larger, but the indicated range is typical. The specified comparative tests were run on the same guitar, except that in one case it had a conventional production model nut and in the other case it had the nut of the present specific example. Several guitars were thus comparatively tested.

In many instances, particularly relative to the lower-pitched strings, the dwell was increased even when the guitarist had his fingers on the strings between the first and tenth frets. When the guitarist's fingers were closer to the body of the guitar, for example above the tenth fret, there was no substantial increase in dwell or sustain. Thus, the present invention increases dwell not only in the open-string condition (no finger on any fret) but in various other string conditions.

There has thus been described a very simple, attractive, practical, economical, nut, and electric Spanish guitar incorporating the same, which make it possible to eliminate string guides and which in the great majority of instances produce the major advantage of markedly increased dwell or sustain.

The foregoing detailed description is to be clearly understood as given by way of illustration and example only, the spirit and scope of this invention being limited solely by the appended claims.

I claim:

1. An electric Spanish-style guitar, which comprises:
(a) a guitar body,
(b) an elongated neck extending from said body and having a head at the outer end thereof,
(c) a plurality of guitar strings anchored to said body and extending over a bridge on said body and thence along said neck to adjustable tuning means on said head,
said strings being formed of metal and being maintained under tension by said tuning means,
said strings lying generally in a plane spaced above and parallel to the fingerboard on said neck,
(d) a nut,
said nut having a body through which said strings extend,
said nut incorporating means to effect two bends in each string as it extends from a region over the outer fingerboard end to a region over the inner portion of said head, and
(e) means to mount said nut firmly, fixedly and non-slidably at the junction of said fingerboard and said head,
said bends, said last-named means and said nut body being adapted to increase the dwells of said strings, in comparison to the dwells which would occur if the same guitar had a conventional nut.

2. The invention as claimed in claim 1, in which separate passages are provided through said body for reception of different ones of said strings, thus permitting the extension of said strings through said body.

3. The invention as claimed in claim 2, in which said passages are straight, and are inclined relative to the axis of said neck and also relative to the axes of the long operative or working portion of said strings.

4. The invention as claimed in claim 3, in which said passages lie in planes which are perpendicular to the plane of said fingerboard, said planes containing said passages being parallel to each other and to said neck axis.

5. The invention as claimed in claim 4, in which said passages incline downwardly in directions away from said body, the amounts of incline being about 20 degrees.

6. The invention as claimed in claim 1, in which said nut body is a block of metal, and in which said means to effect said bends comprises edges provided on said body, said edges for each string being so related to each other that the string bends in opposite directions before passing under tension to the associated tuning means.

7. The invention as claimed in claim 6, in which separate inclined passages are formed through said block for said strings, and in which said edges are at the ends of said passages.

8. The invention as claimed in claim 7, in which said edges are about 0.5 inch from each other measured in a direction parallel to said neck axis.

9. The invention as claimed in claim 7, in which said passages have different diameters, the passages for larger-diameter strings being larger in diameter than those for smaller-diameter strings.

10. The invention as claimed in claim 6, in which said tuning means are adjustable tuning screws extending upwardly from said head.

11. The invention as claimed in claim 10, in which said passages incline upwardly in directions away from said head, and in which no string guides are provided on said head.

12. The invention as claimed in claim 6, in which said block is seated on said neck at a seat adjacent the outer end of said fingerboard, and in which screws are provided to clamp said body firmly to said seat.

13. The invention as claimed in claim 1, in which said guitar body is a solid mass of wood.

14. The invention as claimed in claim 1, in which each of said two bends in each string is at least 10 degrees.

15. The invention as claimed in claim 1, in which each of said two bends in each string is at least 15 degrees.

16. The invention as claimed in claim 1, in which said mounting means (e) includes screws extended through said nut and through said neck, and tightly holding said nut seated on said neck.

17. The invention as claimed in claim 16, in which a seat is provided on said neck for said nut, said nut seating flat-wise on said seat and being held tightly thereagainst by said screws.

* * * * *